US009289981B2

(12) United States Patent
Komada et al.

(10) Patent No.: US 9,289,981 B2
(45) Date of Patent: Mar. 22, 2016

(54) HEAD DRIVE UNIT AND INKJET PRINTER

(71) Applicant: KONICA MINOLTA, INC., Chiyoda-ku (JP)

(72) Inventors: Naoya Komada, Atsugi (JP); Shingo Tsubotani, Kunitachi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/403,447

(22) PCT Filed: May 24, 2013

(86) PCT No.: PCT/JP2013/064482

§ 371 (c)(1),
(2) Date: Nov. 24, 2014

(87) PCT Pub. No.: WO2013/176253

PCT Pub. Date: Nov. 28, 2013

(65) Prior Publication Data

US 2015/0174898 A1 Jun. 25, 2015

(30) Foreign Application Priority Data

May 24, 2012 (JP) ..... 2012-118845

(51) Int. Cl.

| | |
|---|---|
| ***B41J 2/045*** | (2006.01) |
| ***B41J 2/175*** | (2006.01) |
| ***B41J 2/165*** | (2006.01) |
| ***B41J 2/01*** | (2006.01) |

(52) U.S. Cl.

CPC ..... *B41J 2/04573* (2013.01); *B41J 2/01* (2013.01); *B41J 2/0458* (2013.01); *B41J 2/04581* (2013.01); *B41J 2/04588* (2013.01); *B41J 2/04596* (2013.01); *B41J 2/16526* (2013.01); *B41J 2/175* (2013.01)

(58) Field of Classification Search

CPC ..... B41J 29/38; B41J 11/008; B41J 2/0458; B41J 2/04598; B41J 11/0095

See application file for complete search history.

(56) References Cited

U.S. PATENT DOCUMENTS 7,578,574 B2 * 8/2009 Suzuki ..... 347/35

FOREIGN PATENT DOCUMENTS

| | | |
|---|---|---|
| JP | 10-250064 | 9/1998 |
| JP | 2000-37867 | 2/2000 |
| JP | 2000-280555 | 10/2000 |
| JP | 2004-330524 | 11/2004 |
| JP | 2006-142676 | 6/2006 |
| JP | 2007-320081 | 12/2007 |
| JP | 2009-196250 | 9/2009 |

* cited by examiner

*Primary Examiner* — Thinh Nguyen
(74) *Attorney, Agent, or Firm* — Cozen O'Connor

(57) ABSTRACT

An object is to provide a head drive unit that prevents an increase in viscosity of inks in nozzles even when a head is present outside an image forming region and also provide an inkjet printer, and the head drive unit includes: a drive signal output device 31 that outputs either a discharge signal or a meniscus oscillation signal to each head; a cycle generator 326 that generates a cyclic oscillation timing signal for the meniscus oscillation signal; an input interruption detector 324 that detects that input of a print timing signal is interrupted; and a drive signal selector 32 that selects the meniscus oscillation signal as a drive signal output from the drive signal output device and continuously applies the meniscus oscillation signal to all nozzles of each head in synchronization with an oscillation timing signal when interruption of the input of the print timing signal is detected.

10 Claims, 13 Drawing Sheets

HEAD DRIVE UNIT AND INKJET PRINTER

RELATED APPLICATIONS

This is a U.S. National Phase Application under 35 USC 371 of International Application PCT/JP2013/064482 filed on May 24, 2013.

This application claims the priority of Japanese application no. 2012-118845 filed May 24, 2012, the entire content of which is hereby incorporated by reference.

TECHNICAL FIELD

The present invention relates to a head drive unit and an inkjet printer, and more particularly to a head drive unit and an inkjet printer that can prevent an increase in viscosity of an ink even when an inkjet head is present outside an image forming region for a recording medium.

BACKGROUND

In an inkjet printer that forms an image by impacting minute droplets from nozzles onto a recording medium, viscosity of an ink in the nozzles is increased when discharge of the droplets is stopped for a small period of time alone, thereby leading to a discharge failure in some situations.

In an actual printing operation, there are some nozzles that keep preventing discharge of droplets depending on image data. In the prior art, a meniscus oscillation signal used for oscillating a liquid surface at a nozzle tip (which will be referred to as a meniscus hereinafter) is uniformly input to all nozzles before or after a discharge signal that is output to an inkjet head in synchronization with a print timing signal. As a result, in the prior art, the ink in the nozzles is caused to flow before or after discharge of the droplets, and viscosity is thereby lowered to stabilize the discharge. Further, in the prior art, the meniscus oscillation signal is applied even to nozzles that do not discharge droplets in synchronization with the print timing signal. As a result, an increase in viscosity of the ink in the nozzles is avoided (Patent Documents 1 and 2).

PRIOR ART DOCUMENTS

Patent Documents

Patent Document 1: Japanese Patent No. 3556794
Patent Document 2: Japanese Patent No. 4345346

SUMMARY OF THE INVENTION

Problem to be Solved by the Invention

Some of inkjet printers include a head drive unit equipped with an inkjet head driven based on a drive signal and a head drive apparatus that applies a discharge signal to the inkjet head based on image data and a print timing signal input from the outside and discharges droplets from nozzles to form an image on a recording medium as well as a print control apparatus that outputs the image data and the print timing signal to the head drive unit. To the print control apparatus are input the image data from a printer control apparatus (a PC or the like) as an external apparatus that controls the entire printer and a print trigger signal indicative of start of printing. The print trigger signal is input from a carriage apparatus when the inkjet head reaches an image forming region for the recording medium based on positional information of the inkjet head in a recording medium width direction (a main scanning direction). The print control apparatus generates the print timing signal in the image forming region based on this print trigger signal and continuously outputs this signal.

In such a inkjet printer, in case of preventing an increase in viscosity of the ink in the nozzles like the conventional technology, since the meniscus oscillation signal for oscillating the meniscus is applied in synchronization with the print timing signal, an increase in viscosity of the ink can be effectively avoided during printing on the recording medium. However, during a period that the inkjet head is present outside the image forming region between a scan that the inkjet head moves along the main scanning direction crossing a carrying direction (a sub-scanning direction) of the recording medium and a subsequent scan (a period for acceleration/deceleration, stop, and reversal of a scan operation), since the image data is not present and the print timing signal is not input from the print control apparatus, the meniscus oscillation signal cannot be input, and hence an increase in viscosity of the ink in the nozzles cannot be prevented outside this image forming region.

Furthermore, when an external printer control apparatus adds dummy image data that is not printed to the end of image data corresponding to one scan operation, the meniscus oscillation signal can be applied even if the inkjet head is present outside the image forming region between scans. However, since the printer control apparatus does not have means for acquiring a print trigger signal output from the carriage apparatus that is another apparatus and timing to start subsequent print is unknown, it is difficult to determine a level of dummy image data to be provided. Moreover, since excess data that is the dummy image data is transmitted to the print control apparatus, there occurs a problem that an actual transfer rate is lowered and a print throughput is also decreased.

On the other hand, when the print control apparatus is set to transmit the dummy image data to the head drive apparatus, it may be possible to realize application of the meniscus oscillation signal even if the inkjet head is present outside the image forming region. However, fundamentally, since the print control apparatus does not have an image data generating function, unnecessary processing for generating the dummy image data is added. Since the print control apparatus requires ultrahigh-speed processing, e.g., data reception from an external apparatus (the printer control apparatus) or storage of image data in a memory in the apparatus, if unnecessary processing is added, a faster CPU or FPGA is required to meet demanded specifications, which results in a great increase in cost.

Thus, it is an object of the present invention is to provide a head drive unit that enables applying a meniscus oscillation signal and preventing an increase in viscosity of an ink in a nozzle even when an inkjet head is present outside an image forming region of a recording medium where a print timing signal is not acquired, and to provide an inkjet printer including this head drive unit.

Further, the discharge failure problem caused due to an increase in viscosity of the ink can be avoided by forcedly continuously discharging droplets from the nozzles. However, in this case, since the print timing signal cannot be acquired when the inkjet head is present outside the image forming region, a signal used for forcedly discharging the droplets (which will be referred to as a flushing signal hereinafter) cannot be applied to the inkjet head, and there is the same problem as that in case of the meniscus oscillation signal.

Therefore, it is another object of the present invention to provide a head drive unit that enables preventing an increase in viscosity of an ink in a nozzle by forcedly discharge a droplet from the nozzle even when an inkjet head is present outside an image forming region of a recording medium where a print timing signal cannot be acquired, and to provide an inkjet printer including this head drive unit.

Furthermore, it is still another object of the present invention to provide a head drive unit that enables preventing an increase in viscosity of an ink in a nozzle by selecting either application of a meniscus oscillation signal or forced discharge of a droplet from the nozzle even when an inkjet head is present outside an image forming region of a recording medium where a print timing signal cannot be acquired, and to provide an inkjet printer including this head drive unit.

Other objects of the present invention will become obvious from the following description.

Means for Solving Problem

To realize at least one of the above-described objects, a head drive unit and an inkjet printer reflecting one aspect of the present invention has the following.

A head drive unit comprising:

an inkjet head driven based on a drive signal; and a head drive apparatus that outputs a discharge signal to the inkjet head based on image data and a print timing signal that are input from an external apparatus, and discharges a droplet from a nozzle to form an image on a recording medium, wherein the head drive apparatus comprises:

a drive signal output unit for outputting either the discharge signal used for discharging a droplet from the nozzle to form an image or a meniscus oscillation signal used for an oscillating meniscus at a tips of the nozzle without discharging a droplet from the nozzle as a drive signal to the inkjet head;

a cycle generation unit for generating a cyclic oscillation timing signal for the meniscus oscillation signal;

an input interruption detection unit for detecting that no input is made and input of the print timing signal is interrupted even though a preset time has elapsed by monitoring input of the print timing signal; and a drive signal selection unit for selecting the meniscus oscillation signal as the drive signal output from the drive signal output unit and continuously applying the meniscus oscillation signal to all the nozzles of the inkjet head in synchronization with the oscillation timing signal when the input interruption detection unit detects that input of the print timing signal has been interrupted.

A head drive unit comprising:

an inkjet head driven based on a drive signal; and a head drive apparatus that outputs a discharge signal to the inkjet head based on image data and a print timing signal that are input from an external apparatus, and discharges a droplet from a nozzle to form an image on a recording medium, wherein the head drive apparatus comprises:

a drive signal output unit for outputting either the discharge signal used for discharging a droplet from the nozzle to form an image or a flushing signal used for forcedly discharging a droplet from the nozzle without forming an image as a drive signal to the inkjet head;

a cycle generation unit for generating a cyclic flushing timing signal for the flushing signal;

an input interruption detection unit for detecting that no input is made and input of the print timing signal is interrupted even though a preset time has elapsed by monitoring input of the print timing signal; and a drive signal selection unit for selecting the flushing signal as the drive signal output from the drive signal output unit and continuously applying the flushing signal to all the nozzles of the inkjet head in synchronization with the flushing timing signal when the input interruption detection unit detects that input of the print timing signal has been interrupted.

A head drive unit comprising:

an inkjet head driven based on a drive signal; and a head drive apparatus that outputs a discharge signal to the inkjet head based on image data and a print timing signal that are input from an external apparatus, and discharges a droplet from a nozzle to form an image on a recording medium, wherein the head drive apparatus comprises:

a drive signal output unit for outputting either the discharge signal used for discharging a droplet from the nozzle to form an image or a meniscus oscillation signal for an oscillating liquid surface at a tip of the nozzle without discharging a droplet from the nozzle or a flushing signal used for forcedly discharging a droplet from the nozzle without forming an image to the inkjet head;

a cycle generation unit for generating at least either a cyclic oscillation timing signal for the meniscus oscillation signal or a cyclic flushing timing signal for the flushing signal;

an input interruption detection unit for detecting that no input is made and input of the print timing signal is interrupted even though a preset time has elapsed by monitoring input of the print timing signal; and a drive signal selection unit for selecting the meniscus oscillation signal or the flushing signal as the drive signal output from the drive signal output unit and continuously applying the selected signal to all the nozzles of the inkjet head in synchronization with the oscillation timing signal or the flushing timing signal when the input interruption detection unit detects that input of the print timing signal has been interrupted.

An inkjet printer comprising:

a head drive unit according to any one of the above-mentioned head drive units;

a recording medium carrying apparatus for carrying the recording medium in a sub-scanning direction;

a head moving apparatus for moving the inkjet head in a main scanning direction crossing a carrying direction of the recording medium;

a positional information detecting apparatus for detecting positional information of the inkjet head relative to the recording medium; and a print control apparatus that continuously outputs the image data and the print timing signal to the head drive apparatus based on the positional information detected by the positional information detecting apparatus only when the inkjet head is present in an image forming region for the recording medium.

DESCRIPTION OF THE PREFERRED EMBODIMENTS

Embodiments according to the present invention will now be described with reference to the drawings.

Figure 1:
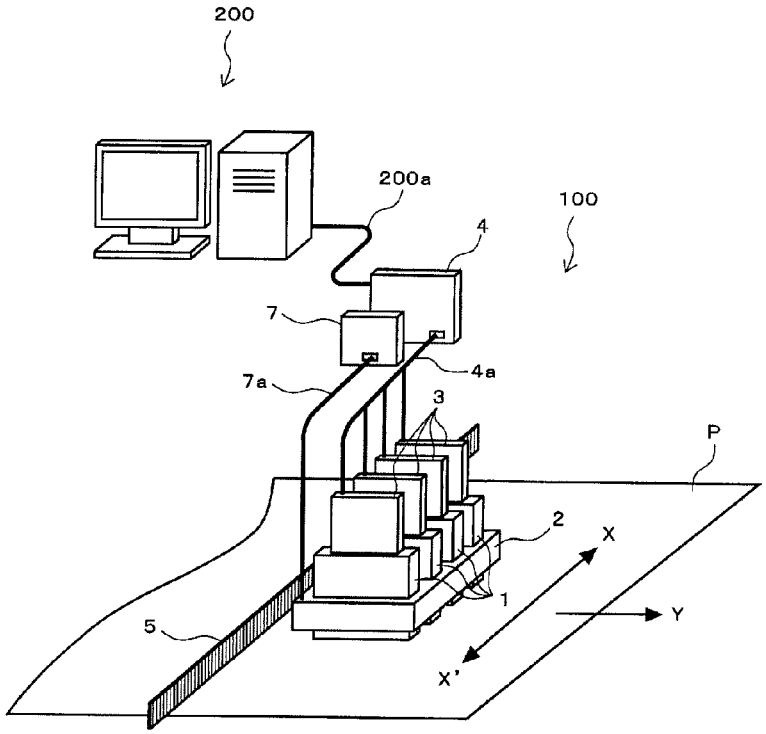
FIG. 1 is an overall structural view showing an inkjet system including an inkjet printer.
Figure 2:
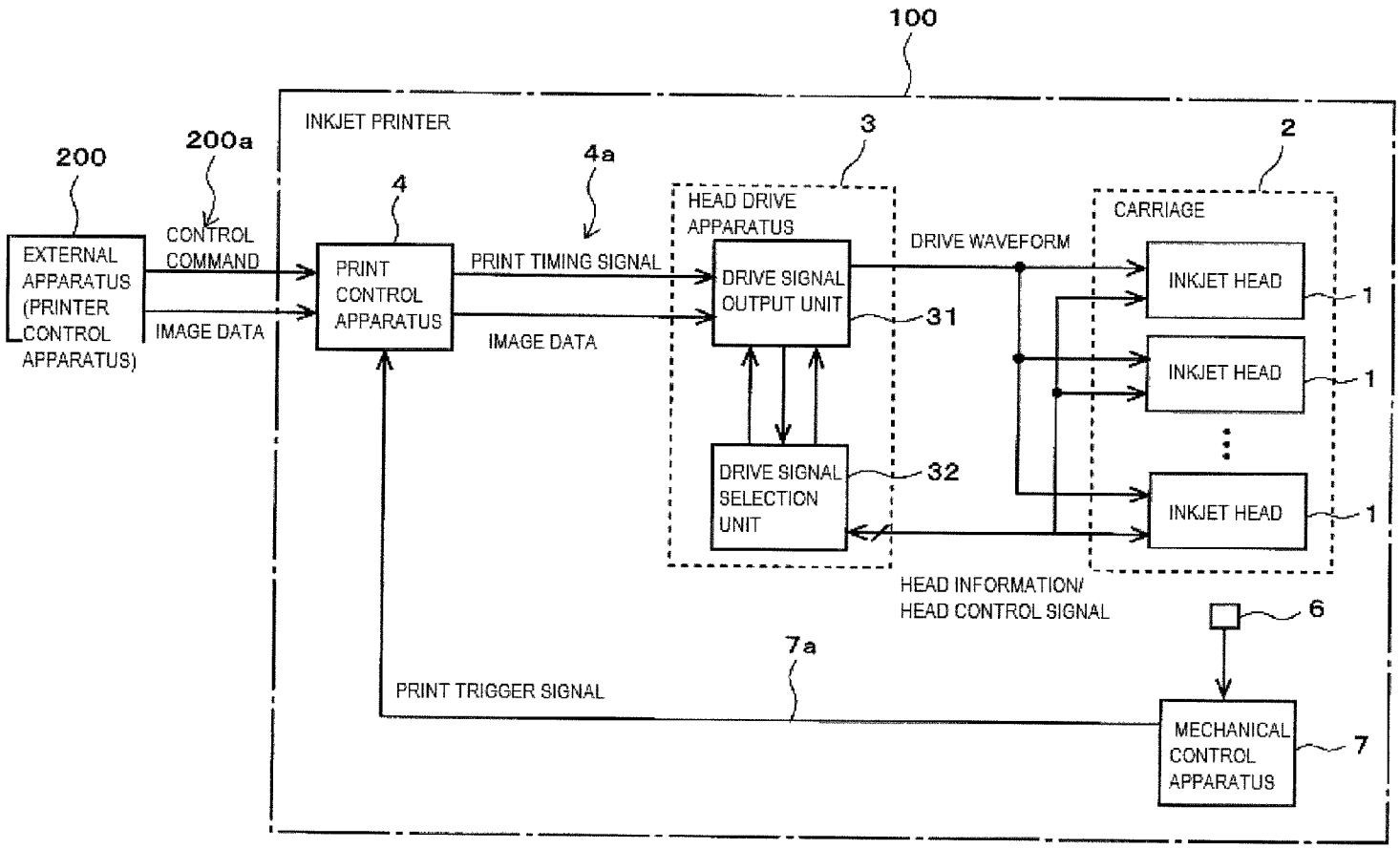
FIG. 2 is a structural block diagram showing an example of the inkjet system including the inkjet printer.

FIG. 1 is an overall structural view showing an example of an inkjet system including an inkjet printer, and FIG. 2 is a structural block diagram thereof.

In the drawings, reference numeral 100 denotes an inkjet printer, and 200 designates a printer control apparatus that is an external apparatus configured to control the entire inkjet printer 100.

In the inkjet printer 100, reference numeral 1 denotes each inkjet head (which will be simply referred to as a head hereinafter), and the inkjet heads 1 are mounted on a common carriage 2 in such a manner that nozzle surfaces having nozzles that discharge inks aligned thereon face the lower side in the drawing. Here, four heads that discharge inks in different colors are exemplified. However, the number of the heads 1 does not really matter. The carriage 2 is provided to be reciprocable along a main scanning direction represented as X-X' in the drawing by non-illustrated head moving apparatus.

In the present invention, a configuration of the head 1 is not really matter, it is arbitrary to adopt, e.g., a configuration that a piezoelectric element such as a PZT is driven by applying a drive signal, a volume of an ink chamber is contracted, and a pressure is provided to the ink to thereby discharge the ink from each nozzle or a configuration that a heater is energized by applying a drive signal, the ink is heated to generate air bubbles, and the ink in the ink chamber is discharged from the nozzles by a rupture action of the air bubbles.

A recording medium P is arranged below the carriage 2 to face the nozzle surfaces of the heads 1. The recording medium P is intermittently carried at a predetermined velocity along a sub-scanning direction represented as Y in the drawing by a non-illustrated recording medium carrying apparatus having, e.g., a carrying roller pair that holds the recording medium P and rotates to perform carriage and a carrying belt that has the recording medium P mounted thereon and carries it.

Head drive apparatuses 3 configured to drive the heads 1 are mounted on the carriage 2 in proximity to the respective heads 1. The heads 1 and the head drive apparatuses 3 constitute a head drive unit.

When image data, a print timing signal, or various kinds of control commands are transmitted from a print control apparatus 4 formed of, e.g., a CPU or an FPGA provided in the inkjet printer 100 through a signal line 4*a*, each head drive apparatus 3 outputs a drive signal to each head 1 based on the image data, the print timing signal, and the various kinds of control commands. Particulars of an internal structure of the head drive apparatus 3 will be described later.

In FIG. 1, reference numeral 5 denotes a linear encoder, and it is arranged along the main scanning direction. An encoder sensor 6 (see FIG. 2) is provided to the carriage 2, and continuous pulse signals are detected from the linear encoder 5 when the carriage 2 moves along the main scanning direction. The combination of the linear encoder 5 and the encoder sensor 6 is an example of positional information detecting apparatus for detecting positional information of each head 1 relative to the recording medium P. Each detected pulse signal is transmitted to a mechanical control apparatus 7 formed of, e.g., the CPU or the FPGA provided in the inkjet printer 100 through a signal line 7*a*. The mechanical control apparatus 7 acquires positional information of the carriage 2 along the main scanning direction based on the pulse signal.

The mechanical control apparatus 7 controls reciprocation of the carriage 2 along the main scanning direction and carriage of the recording medium P along the sub-scanning direction. Each head 1 is driven and controlled by the head drive apparatus 3 based on image data, a print timing signal, or various kinds of control commands transmitted from the print control apparatus 4 during a period that the heads 1 are present in an image forming region on the recording medium P in a process of the reciprocation of the carriage 2 along the main scanning direction controlled by this mechanical control apparatus 7, and each head 1 discharges droplets from the nozzles to form an image on the recording medium P.

Figure 3:
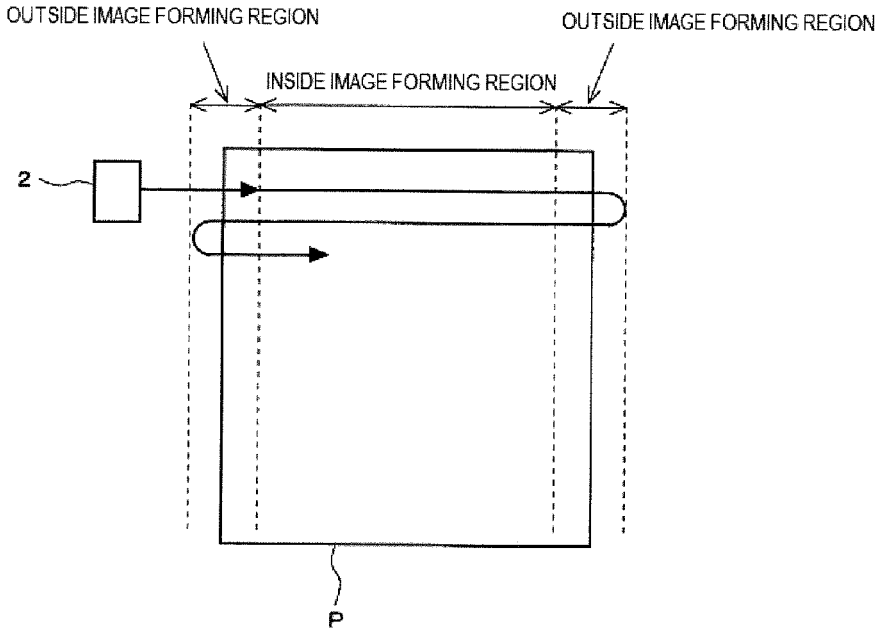
FIG. 3 is a view for explaining the inside and outside of image forming regions relative to a recording medium.

At the time of the reciprocation of the carriage 2 along the main scanning direction, as shown in FIG. 3, the carriage 2 starts acceleration from the outside of the image forming region on one side of the recording medium P, cuts across the image forming region on the recording medium P at a fixed velocity, again reaches the outside of the image forming region on the other side of the recording medium P, and then repeats an operation of performing deceleration, stop, and reversal outside the image forming region and again starting acceleration toward the inside of the image forming region. The mechanical control apparatus 7 is configured to determine whether the carriage 2 has reached the image forming region from the outside of the image forming region for the recording medium P from acquired positional information of the carriage 2 along the main scanning direction. Moreover, when the carriage 2 comes close to the image forming region, the mechanical control apparatus 7 generates a print trigger signal indicative of start of print and transmits it to the print control apparatus 4. The print control apparatus 4 generates the print timing signal upon reception of the print trigger signal only when the carriage 2 is present in the image forming region, and it transmits this signal to each head drive apparatus 3 together with image data and any other various kinds of control commands.

The printer control apparatus 200 that is an external apparatus of the inkjet printer 100 is constituted of a PC. The printer control apparatus 200 holds image data and transmits the image data and various kinds of control commands that control the entire inkjet printer 100 to the print control apparatus 4.

Figure 4:
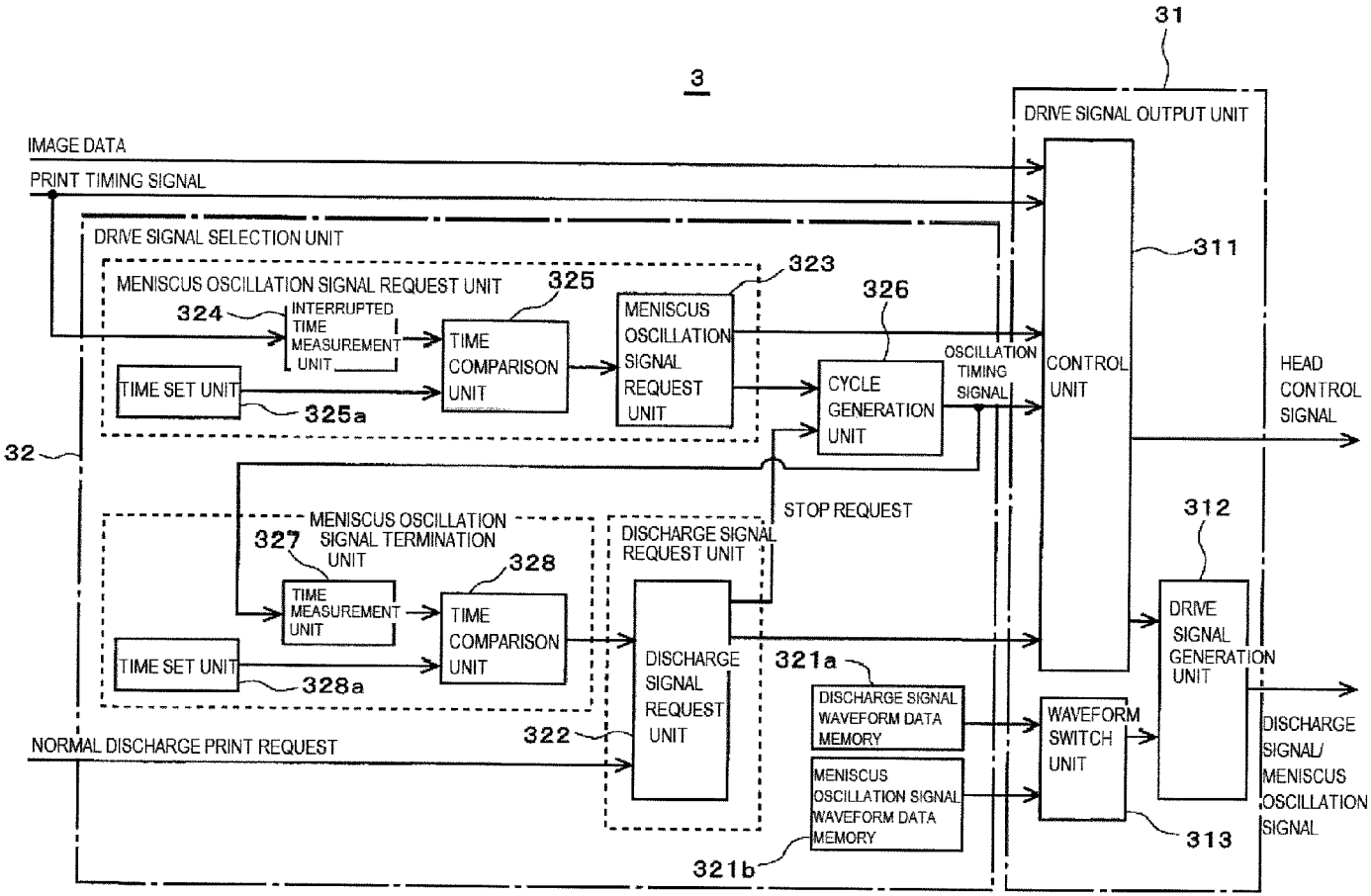
FIG. 4 is a structural block diagram showing an example of a head drive apparatus.

FIG. 4 is a structural block diagram showing an example of the internal configuration of the head drive apparatus 3.

The head drive apparatus 3 has a drive signal output unit 31 and a drive signal selection unit 32. As represented by examples in FIG. 5, this head drive apparatus 3 can generate a discharge signal (FIG. 5(*a*)) used for discharge a droplet from a nozzle to form an image and a meniscus oscillation signal (FIG. 5(*b*)) that has a lower peak value than the discharge signal and is used for oscillating a meniscus at each nozzle tip without discharging a droplet from the nozzle as a drive signal output to the head 1. The drive signal selection unit 32 has a discharge signal waveform data memory 321*a* that stores waveform data of the discharge signal and a meniscus oscillation signal waveform data memory 321*b* that stores waveform data of the meniscus oscillation signal. The discharge signal waveform data in the discharge signal waveform data memory 321*a* and the meniscus oscillation signal waveform data in the meniscus oscillation signal waveform data memory 321*b* are output to the drive signal output unit 31.

The drive signal output unit 31 has a control unit 311 that outputs a head control signal to each head 1, a drive signal generation unit 312 that is controlled by the control unit 311 and outputs a drive signal to the head 1, and a waveform switch unit 313 that is controlled by the control unit 311 and switches a drive signal waveform that is output to the drive signal generation unit 312 to either a discharge signal waveform from the discharge signal waveform data memory 321*a* of the drive signal selection unit 32 or a meniscus oscillation signal waveform from the meniscus oscillation signal waveform data memory 321*b*.

The control unit 311 controls the waveform switch unit 313 based on a discharge signal request signal or a meniscus oscillation signal request signal output from the drive signal selection unit 32 and switches a drive signal applied to the head 1 to either the discharge signal or the meniscus oscillation signal. Image data and the print timing signal are input to this control unit 311 from the print control apparatus 4. At the time of normal image formation that the carriage 2 is present in the image forming region, the control unit 311 outputs the discharge signal to each head 1 from the drive signal generation unit 312 based on the image data and the print timing signal. As a result, droplets are discharged from the nozzles, and image formation is carried out.

Figure 5:
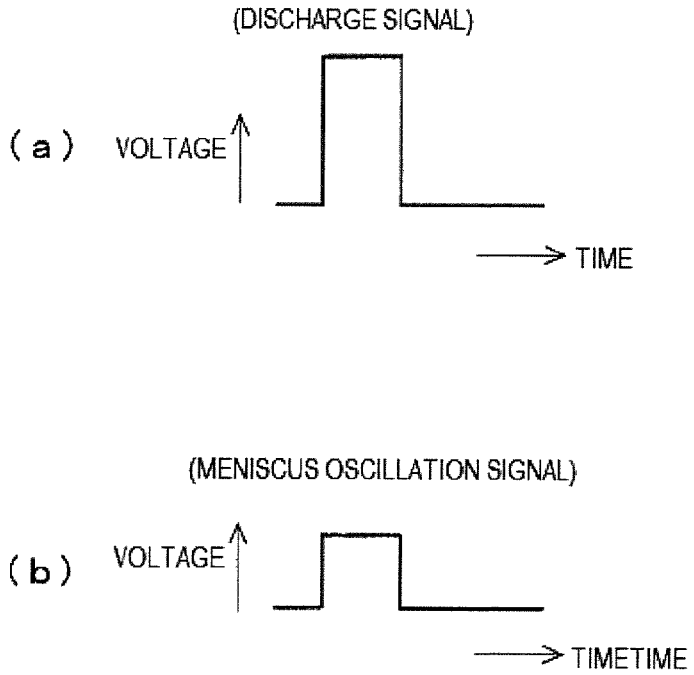
FIG. 5(*a*) is a view showing an example of a discharge signal waveform, and (*b*) is a view showing an example of a meniscus oscillation signal waveform.

It is to be noted that each of the discharge signal shown in FIG. 5(*a*) and the meniscus oscillation signal shown in FIG. 5(*b*) is an example and can be appropriately set in accordance with the configuration of the head 1.

The drive signal selection unit 32 determines which one of the discharge signal and the meniscus oscillation signal is selected as a drive signal output from the drive signal output unit 31 to the head 1 with respect to the control unit 311 of the drive signal output unit 31. The drive signal selection unit 32 has a discharge signal request unit 322 that outputs a discharge signal request signal to the control unit 311 of the drive signal output unit 31 and a meniscus oscillation signal request unit 323 that outputs a meniscus oscillation signal request signal to the control unit 311.

Upon inputting a print request signal for performing normal image formation that is transmitted from the print control apparatus 4 when the carriage 2 is present within the image forming region, the discharge signal request unit 322 outputs the discharge signal request signal to the control unit 311 of the drive signal output unit 31. On the other hand, when the carriage 2 is present outside the image forming region, the meniscus oscillation signal request unit 323 outputs the meniscus oscillation signal request signal to the control unit 311 of the drive signal output unit 31.

Here, to detect that the carriage 2 is present outside the image forming region, the drive signal selection unit 32 has the following configuration.

The print timing signal that is continuously output from the print control apparatus 4 is also input to the drive signal selection unit 32. An interrupted time measurement unit 324 that monitors cyclic input of the continuous print timing signal is provided to the drive signal selection unit 32.

The interrupted time measurement unit 324 measures an interrupted time during which no print timing signal is input from input of one (corresponding to one pulse) print timing signal to input of a subsequent (corresponding to one pulse) print timing signal, and outputs a measured value to a time comparison unit 325. The time comparison unit 325 compares this interrupted time with a set time previously set in a time set unit 325*a*. This set time is set to a time that is sufficient to estimate that the print timing signal is interrupted by movement of the carriage 2 to the outside of the image forming region. Further, when the measured value exceeds the set time as a result of comparison between the measured value and the set time, the time comparison unit 325 outputs a signal indicating that the set time has elapsed, i.e., a signal indicating that the carriage 2 is present outside the image forming region to the meniscus oscillation signal request unit 323.

It is to be noted that the interrupted time measurement unit 324, the time comparison unit 325 and the time set unit 325*a* of the drive signal selection unit 32 constitute input interruption detection unit.

When this signal has been input, the meniscus oscillation signal request unit 323 outputs the meniscus oscillation signal request signal to the control unit 311 of the drive signal output unit 31 and also outputs the signal to a cycle generation unit 326.

The cycle generation unit 326 is a cycle generate unit for generating an oscillation timing signal as a cycle signal used for continuously outputting the meniscus oscillation signal shown in FIG. 5(*b*) upon receiving the signal from the meniscus oscillation signal request unit 323. The cycle generation unit 326 outputs this oscillation timing signal to the control unit 311 of the drive signal output unit 31.

The carriage 2 that has reached the outside of the image forming region from the inside of the image forming region then turns around and again enters the image forming region. The drive signal selection unit 32 has the following configuration to detect that the carriage 2 again enters the image forming region.

A time measurement unit 327 for measuring a duration time of the oscillation timing signal output from the cycle generation unit 326 is provided in the drive signal selection unit 32. The duration time measured by the time measurement unit 327 is output to a time comparison unit 328. The time comparison unit 328 compares a measured value of this duration time with a set time previously set in the time set unit 328*a*. This set time is set to a time that is sufficient to estimate that the carriage 2 has reached a point just before again coming near to the image forming region. Additionally, when a measured value exceeds the set time as a result of comparing the measured value and the set time, the time comparison unit 328 outputs a signal indicating that the set time has elapsed, i.e., a signal indicating that the carriage 2 has come near to the image forming region to the discharge signal request unit 322 to restart image formation.

When this signal has been input, the discharge signal request unit 322 outputs the discharge signal request signal to the control unit 311 of the drive signal output unit 31, outputs a stop request signal to the cycle generation unit 326, and terminates the output of the oscillation timing signal. As a result, the output of the meniscus oscillation signal to each head 1 is terminated.

It is to be noted that the time measurement unit 327, the time comparison unit 328 and the time set unit 328*a* of the drive signal selection unit 32 constitute a meniscus oscillation signal termination unit.

Figure 6:
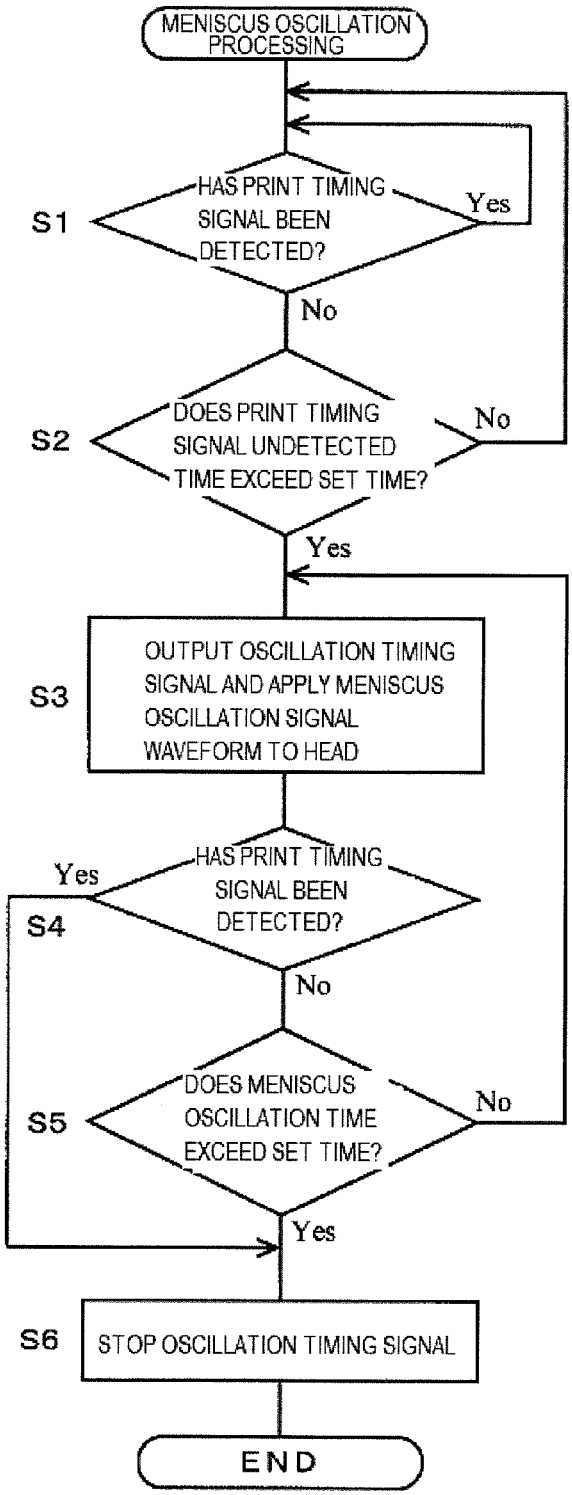
FIG. 6 is a flowchart for explaining meniscus oscillation processing.
Figure 7:
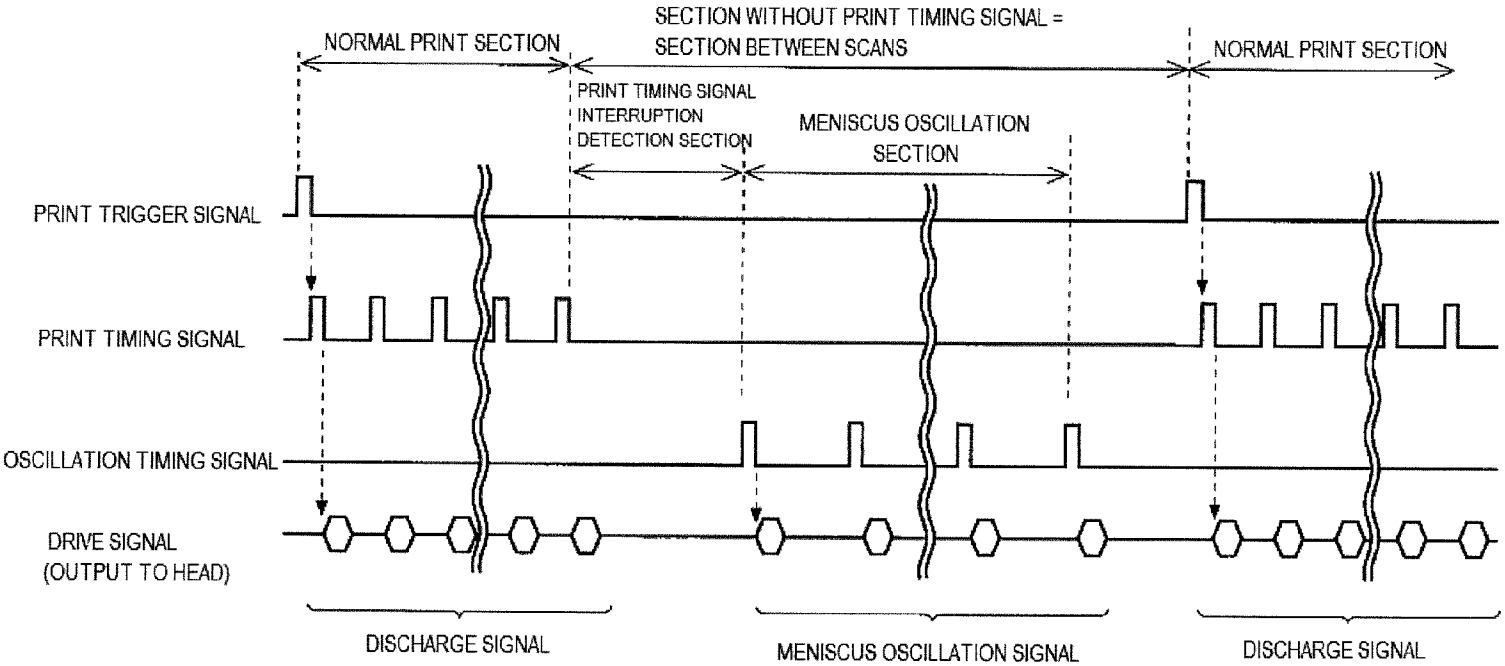
FIG. 7 is a timing chart for explaining the meniscus oscillation processing.

A specific flow of meniscus oscillation processing executed by the inkjet printer 100 will now be described with reference to a flowchart shown in FIG. 6 and a timing chart shown in FIG. 7.

The print control apparatus 4 outputs a discharge print request signal for effecting normal image formation to the head drive apparatus 3 and starts a print operation. Then, the carriage 2 having the heads 1 mounted thereon moves on the recording medium P along the main scanning direction. When the carriage 2 comes near to the image forming region, a print trigger signal is output to the print control apparatus 4 from the mechanical control apparatus 7 based on positional information detected and acquired by the encoder sensor 6. Upon inputting this print trigger signal, the print control apparatus 4 continuously outputs the print timing signal to each head drive apparatus 3. As a result, the head drive apparatus 3 discharges droplets from the nozzles of each head 1 based on the print timing signal and the image data from the print control apparatus 4 and forms an image corresponding to one line on the recording medium P along the main scanning direction.

When the carriage 2 has moved to the outside of the image forming region, since data of an image that should be formed in this one line is no longer present, the print timing signal from the print control apparatus 4 is interrupted. In the drive signal selection unit 32 in each head drive apparatus 3, the interrupted time measurement unit 324 keeps measuring an interrupted time of the print timing signal that is continuously output from the print control apparatus 4 (S1, S2). Furthermore, when the time comparison unit 325 detects that an interrupted time of this print timing signal exceeds a set time that has been set in advance (in case of Yes at S2), the time comparison unit 325 outputs a meniscus oscillation signal request signal to the control unit 311 of the drive signal output unit 31 from the meniscus oscillation signal request unit 323 and also outputs a cyclic oscillation timing signal to the control unit 311 from the cycle generation unit 326.

When the control unit 311 receives the meniscus oscillation signal request signal, the drive signal output unit 31 controls the waveform switch unit 313, and switches a drive signal, which is output from the drive signal generation unit 312 to each head 1, to the meniscus oscillation signal. Then, the drive signal output unit 31 continuously outputs the meniscus oscillation signal to all the nozzles of each head 1 in synchronization with the oscillation timing signal and oscillates meniscuses of all the nozzles (S3).

A state that the print timing signal is not input from the print control apparatus 4 continues while this oscillation timing signal is cyclically output (in case of No at S4). The drive signal selection unit 32 keeps measuring a duration time of output of the oscillation timing signal in the time measurement unit 327 (S5). Furthermore, when the time comparison unit 328 detects that the duration time of this oscillation timing signal exceeds a set time that has been previously set (in case of Yes at S5), the drive signal selection unit 32 outputs a discharge signal request signal to the control unit 311 of the drive signal output unit 31 from the discharge signal request unit 322 and outputs a stop request signal to the meniscus oscillation signal cycle generation unit 326. As a result, the output of the oscillation timing signal is stopped (S6).

It is to be noted that, here, if input of the print timing signal has been detected after output of the oscillation timing signal and before elapse of the set time (Yes at S4), the drive signal selection unit 32 likewise outputs the stop request signal to the meniscus oscillation signal cycle generation unit 326 and stops the oscillation timing signal.

Then, when the carriage 2 again moves close to the image forming region to form an image corresponding to a next line, the print trigger signal is again output to the print control apparatus 4 from the mechanical control apparatus 7 based on positional information detected and acquired by the encoder sensor 6, droplets are likewise discharged from the nozzles of each head 1, and the image corresponding to one line is formed along the main scanning direction.

According to this head drive unit (the heads 1 and the head drive apparatuses 3) and the inkjet printer 100 including this unit, even when the heads 1 are present outside the image forming region of the recording medium P where the print timing signal is not acquired, the meniscus oscillation signal can be generated in each head drive apparatus 3 and output to each head 1, and meniscuses of all the nozzles can be oscillated to avoid an increase in viscosity of the inks in the nozzles. Since each head drive apparatus 3 is fundamentally a portion that controls the drive signal output to each head 1, the meniscus oscillation signal can be output to all the nozzles of the head 1 irrespective of image data. As a result, a considerable circuit change or addition of complicated processing is not required.

Moreover, according to this head drive unit and the inkjet printer 100, when the drive signal selection unit 32 measures a time during which output of the meniscus oscillation signal continues and detects that the duration time exceeds a preset time, the meniscus oscillation signal is stopped, the drive signal is switched to the discharge signal, and hence each head drive apparatus 3 can automatically oscillate the meniscus between scans in the main scanning direction. Therefore, the meniscuses of all the nozzles can be oscillated when the carriage 2 is present outside the image forming region without imposing a burden on the print control apparatus 4 or a host external apparatus (the printer control apparatus 200), thereby stabilizing discharge.

In the above-described embodiment, the meniscus oscillation signal termination unit measures a duration time of the cyclic oscillation timing signal continuously output from the cycle generation unit 326 with the use of the time measurement unit 327, the number of times of outputting of the respective oscillation timing signals may be measured.

Figure 8:
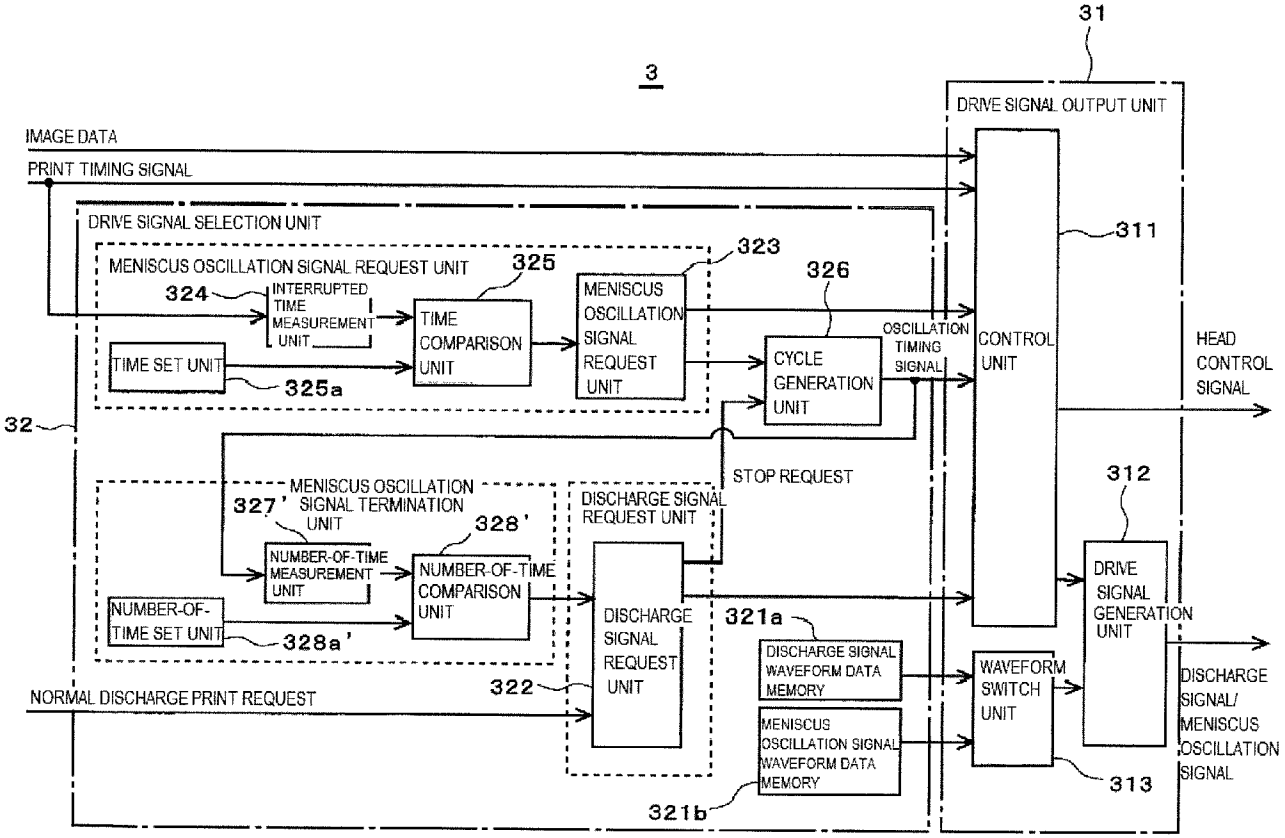
FIG. 8 is a structural block diagram of a head drive apparatus according to another embodiment.

FIG. 8 shows this embodiment. A number-of-time measurement unit 327' for measuring the number of times of outputting the oscillation timing signal is provided to the meniscus oscillation signal termination unit. The number-of-time measurement unit 327' is configured to output a measured value of the number of times of outputting the oscillation timing signal to a number-of-time comparison unit 328'. The number-of-time comparison unit 328' compares this measured value of the number of times of output with a set number of times that has been previously set in a number-of-time set unit **328*a*'. This set number of times is set to the number of times that is sufficient to estimate that the carriage 2 has reached a point just before again coming close to the image forming region. Additionally, when the number-of-time comparison unit 328' detects that the measured value has reached the set number of times, it outputs a signal indicating that output has been made for the set number of times, i.e., a signal indicating that the carriage 2 comes close to the image forming region to the discharge signal request unit 322** to restart image formation.

According to this embodiment, it is possible to provide the same effect as that in case of measuring a duration time of output of the oscillation timing signal.

Figure 9:
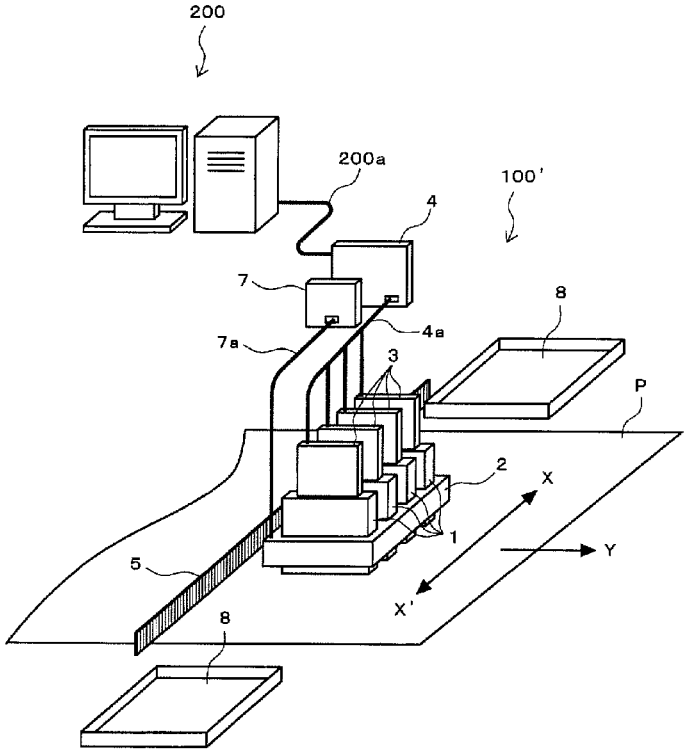
FIG. 9 is an overall structural view showing an example of an inkjet system including an inkjet printer in case of performing flushing.
Figure 10:
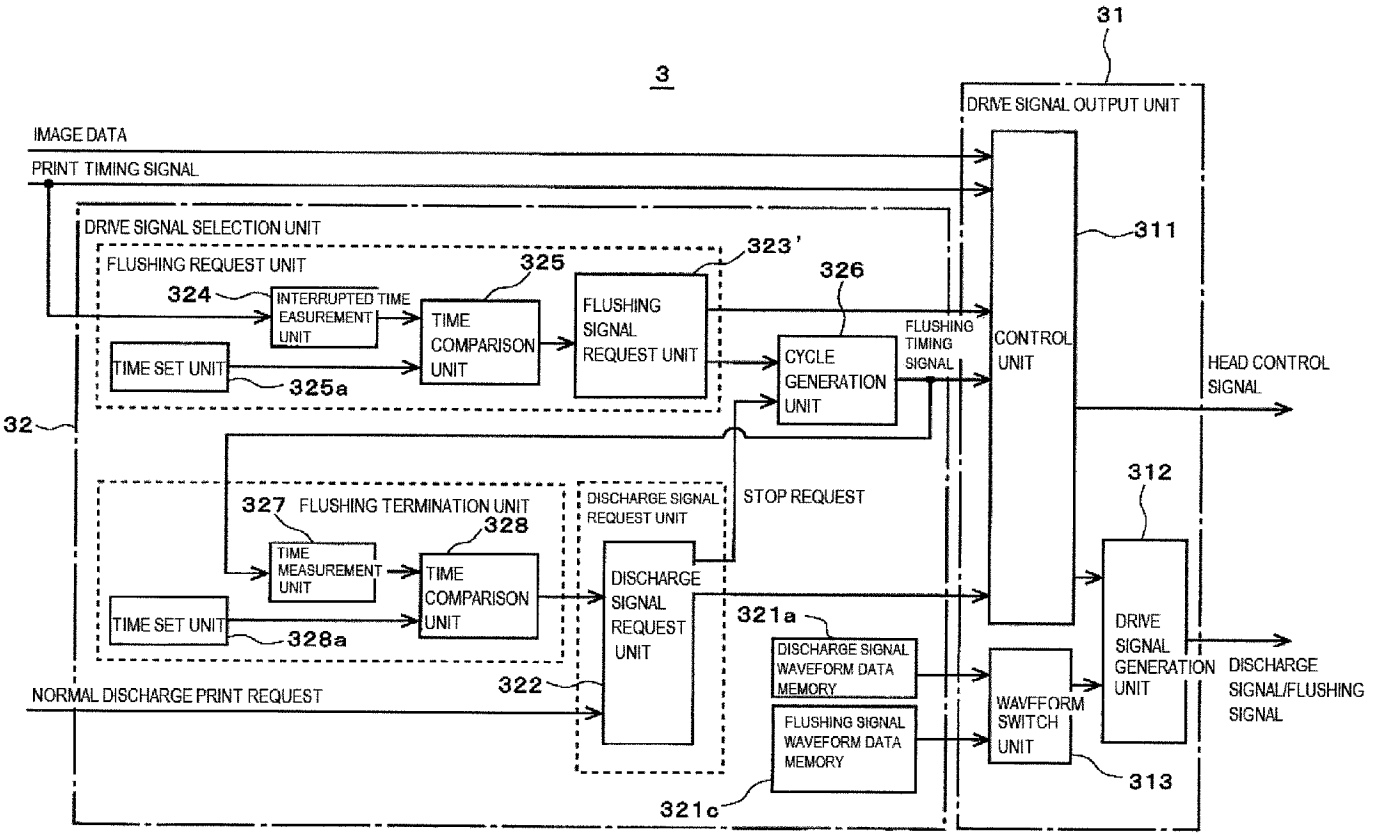
FIG. 10 is a structural block diagram showing an example of the head drive apparatus in case of performing flushing.

FIG. 9 is an overall structural view showing an example of an inkjet printer system including an inkjet printer 100' according to another embodiment to avoid an increase in viscosity of inks in nozzles, and FIG. 10 shows an example of an internal configuration of a head drive apparatus 3 in the inkjet printer 100'. Since portions denoted by the same reference numerals as those in FIG. 1 and FIG. 4 represent portions having the same structures, explanation thereof will be used, and a description here will be omitted.

An ink receiver 8 configured to receive droplets forcedly discharged from each head 1 is arranged outside an image forming regions on both sides of a recording medium P in this inkjet printer 100'.

Each head drive apparatus 3 can generate a discharge signal used for discharging droplets from nozzles to perform image formation and a flushing signal used for forcedly discharging droplets from the nozzles without performing image formation as drive signals that are output to each head 1. This head drive apparatus 3 has a discharge signal waveform data memory 321*a* that stores waveform data of the discharge signal and a flushing signal waveform data memory 321*c* that stores waveform data of the flushing signal in a head drive signal selection unit 32.

Therefore, when a waveform switch unit 313 of a drive signal output unit 31 is controlled by a control unit 311, it switches the drive signal that is to be output to a drive signal generation unit 312 to either a discharge signal waveform that is output from the discharge signal waveform data memory 321*a* of the drive signal selection unit 32 or a flushing signal waveform that is output from the flushing signal waveform data memory 321*c*.

The flushing signal waveform that is stored in this flushing signal waveform data memory 321*c* is arbitrary as long as it enables forcedly discharging droplets from the nozzles, and it can be appropriately set in accordance with a structure of each head 1. Here, a description will be given as to an illustrative example of the flushing signal waveform having a signal waveform different from the discharge signal waveform. However, as to the flushing signal waveform, a signal having the same waveform as the discharge signal waveform may be used. When the flushing signal waveform is the same as the discharge signal waveform, the flushing signal waveform data memory 321*c* and the waveform switch unit 313 may be eliminated. In this case, it is good enough to configure the discharge signal waveform stored in the discharge signal waveform data memory 321*a* to be output to the dive signal generation unit 312.

The drive signal selection unit 32 determines which one of the discharge signal and the flushing signal corresponds to the drive signal applied from the drive signal output unit 31 to each head 1 with respect to the control unit 311 of the drive signal output unit 31. Therefore, the drive signal selection unit 32 has a flushing signal request unit 323' that transmits a flushing signal request signal to the control unit 311 when the carriage 2 is present outside the image forming region. The flushing signal request unit 323' outputs a signal indicating that a set time has elapsed, i.e., a signal indicating that the carriage 2 is present outside the image forming region from a time comparison unit 325.

When a signal has been input from the time comparison unit 325, the flushing signal request unit 323' outputs a flushing signal request signal to the control unit 311 of the drive signal output unit 31 and also outputs a signal to a cycle generation unit 326.

Upon receiving a signal from the flushing signal request unit 323', the cycle generation unit 326 generates a cycle for making flushing signals continuous and outputs it as a flushing timing signal to the control unit 311 of the drive signal output unit 31. As a result, when the carriage 2 is present outside the image forming region, droplets from all the nozzles are forcedly discharged to the ink receiver 8.

A time measurement unit 327 measures a duration time of output of the flushing timing signal from the cycle generation unit 326, outputs a signal indicating that a set time has elapsed to a discharge signal request unit 322 like the example of the oscillation timing signal, and terminates output of the flushing signal.

Figure 11:
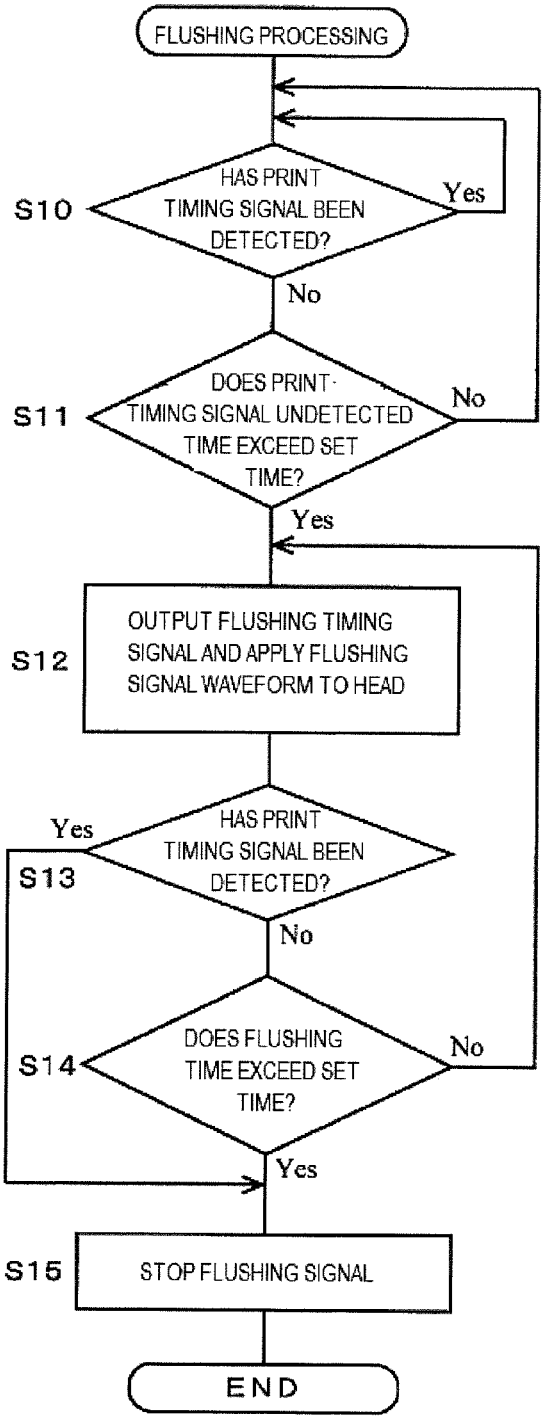
FIG. 11 is a flowchart for explaining the flushing processing.

A specific flow of meniscus oscillation processing executed by this inkjet printer 100' will now be described with reference to a flowchart shown in FIG. 11.

A print control apparatus 4 outputs a discharge print request signal for effecting normal image formation to each head drive apparatus 3 and starts a print operation. Then, the carriage 2 having the heads 1 mounted thereon moves on a recording medium P along a main scanning direction. When the carriage 2 comes near to the image forming region, a print trigger signal is output to the print control apparatus 4 from a mechanical control apparatus 7 based on positional information detected and acquired by an encoder sensor 6. Upon inputting this print trigger signal, the print control apparatus 4 continuously outputs the print timing signal to each head drive apparatus 3. As a result, the head drive apparatus 3 discharges droplets from the nozzles of each head 1 based on the print timing signal and image data from the print control apparatus 4 and forms an image corresponding to one line on the recording medium P along the main scanning direction.

When the carriage 2 has moved to the outside of the image forming region, since data of an image that should be formed in this one line is no longer present, the print timing signal from the print control apparatus 4 is interrupted. In the drive signal selection unit 32 in each head drive apparatus 3, an interrupted time measurement unit 324 keeps measuring an interrupted time of the print timing signal that is continuously output from the print control apparatus 4 (S10, S11). Furthermore, upon detecting that an interrupted time of this print timing signal exceeds a set time that has been set in advance (in case of Yes at S11), the drive signal selection unit 32 outputs a flushing signal request signal to the control unit 311 of the drive signal output unit 31 from the flushing signal request unit 323' and also outputs a cyclic flushing timing signal to the control unit 311 from the cycle generation unit 326.

When the control unit 311 receives the flushing signal request signal, the drive signal output unit 31 controls the waveform switch unit 313, and switches a drive signal, which is output from the drive signal generation unit 312 to each head 1, to the flushing signal. Then, the drive signal output unit 31 continuously outputs the flushing signal to all the nozzles of each head 1 in synchronization with the flushing timing signal and forcedly discharges droplets from all the nozzles (S12).

A state that the print timing signal is not input from the print control apparatus 4 continues while the flushing timing signal is cyclically output (in case of No at S13). The drive signal selection unit 32 keeps measuring a duration time of output of the flushing timing signal in the time measurement unit 327 (S14). Upon detecting that the duration time of this flushing timing signal has exceeded a set time that has been previously set (in case of Yes at S14), the drive signal selection unit 32 outputs a discharge signal request signal to the control unit 311 of the drive signal output unit 31 from the discharge signal request unit 322 and outputs a stop request signal to the cycle generation unit 326. As a result, the output of the flushing timing signal is stopped (S15).

It is to be noted that, here, if input of the print timing signal is detected after output of the flushing timing signal and before elapse of the set time (Yes at S13), the drive signal selection unit 32 likewise outputs the stop request signal to the cycle generation unit 326 and stops the flushing timing signal.

Then, when the carriage 2 again moves close to the image forming region to form an image corresponding to next one line, the print trigger signal is again output to the print control apparatus 4 from the mechanical control apparatus 7 based on positional information detected and acquired by the encoder sensor 6. Further, like the above example, droplets are discharged from the nozzles of each head 1, and the image corresponding to one line is formed along the main scanning direction.

Even if the flushing signal is used in place of the meniscus oscillation signal, droplets can be forcedly discharged when the carriage 2 is present outside the image forming region, and an increase in viscosity of inks in the nozzles can be avoided like the example of using meniscus oscillation signal.

The embodiment of using the above-described meniscus oscillation signal as means for avoiding an increase in viscosity of inks in the nozzles when the carriage 2 is present outside the image forming region may be combined with the embodiment of using the flushing signal to select both the signals. This embodiment will now be described hereinafter.

Figure 12:
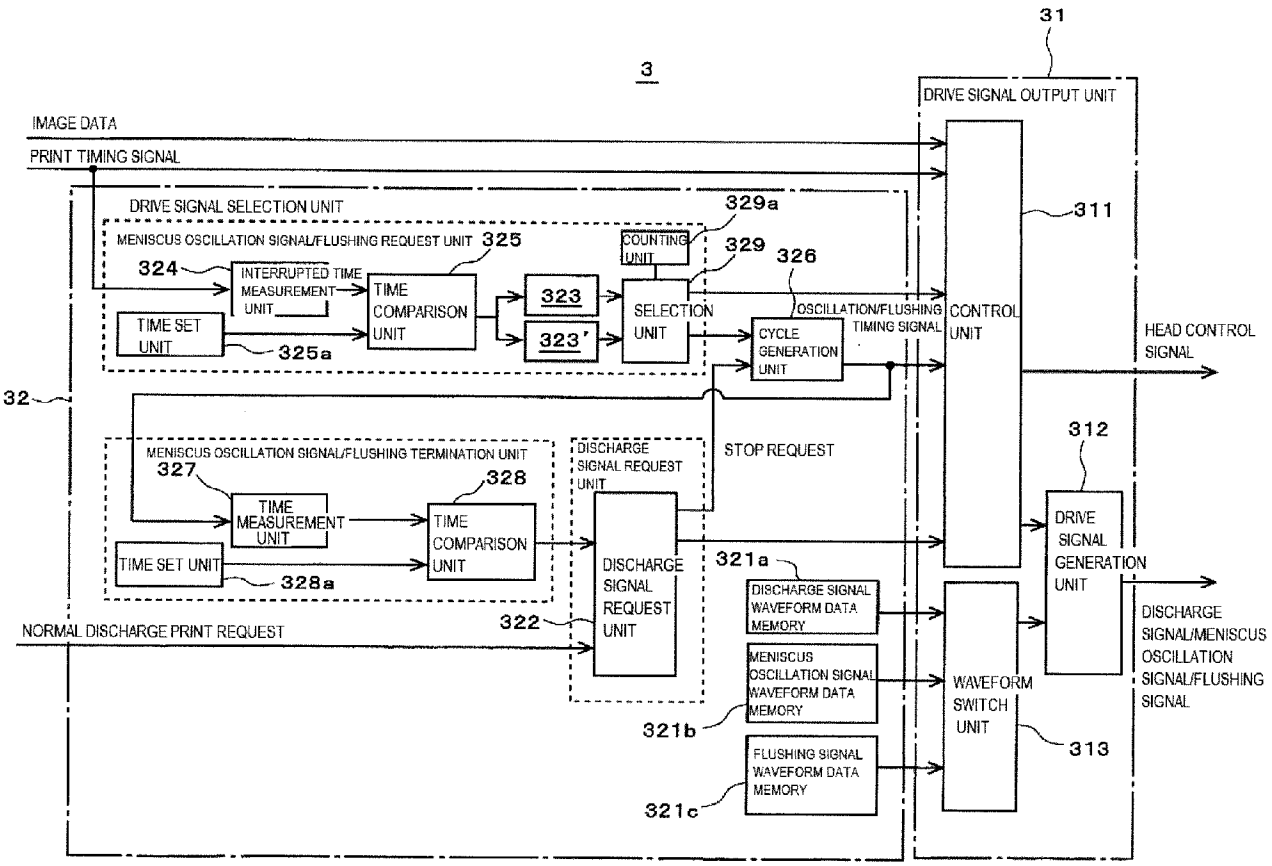
FIG. 12 is a structural block diagram showing an example of the head drive apparatus in case of selecting meniscus oscillation and flushing.

Since an overall configuration of the inkjet head printer system that selects the meniscus oscillation signal and the flushing signal is the same as that in FIG. 9, FIG. 12 show an example of an internal configuration of the head drive apparatus 3 alone. Since portions designated by the same reference numerals as those in FIG. 4 and FIG. 10 represent portions having the same configurations, explanation thereof will be used, a description here will be omitted.

In this embodiment, the drive signal selection unit 32 has a discharge signal waveform data memory 321*a* that outputs a discharge signal waveform to the drive signal output unit 31, a meniscus oscillation signal waveform data memory 321*b* that outputs a meniscus oscillation signal waveform, and a flushing signal waveform data memory 321*c* that outputs a flushing signal waveform.

Further, the drive signal selection unit 32 outputs a detection signal indicating detection of input interruption of the print timing signal in a time comparison unit 325 to the meniscus oscillation signal request unit 323 and the flushing signal request unit 323'. Upon receiving this signal, each of the meniscus oscillation signal request unit 323 and the flushing signal request unit 323' outputs a meniscus oscillation signal request signal and a flushing signal request signal to a selection unit 329, respectively.

The selection unit 329 is selecting means for selecting one of the meniscus oscillation signal request signal and the flushing signal request signal input thereto as a signal that is output to the control unit 311 of the drive signal output unit 31. The selection unit 329 outputs the selected meniscus oscillation signal request signal or flushing signal request signal to the control unit 311 and also outputs the selected signal to the cycle generation unit 326.

Usually, since flushing involves consumption of the inks, it is preferable to set the selection unit 329 so that it can preferentially select the meniscus oscillation signal that does not involve the consumption of the inks at the time of selecting the meniscus oscillation signal or the flushing signal when the carriage 2 is present outside the image forming region. As a result, the consumption of the inks involved by the flushing can be suppressed.

A selecting operation of the selection unit 329 may be carried out by, e.g., manipulating a switch button by an operator, or the meniscus oscillation signal or the flushing signal may be switched in accordance with a preset order. However, as shown in FIG. 12, it is preferable to provide a counting unit 329*a* for counting the number of times of selecting the meniscus oscillation signal by the selection unit 329 to the drive signal selection unit 32, thereby switching the signals based on a counted value provided by this counting unit 329*a*.

The counting unit 329*a* counts the number of times of selecting the meniscus oscillation signal by the selection unit 329 and compares it with a set value (e.g., 10 times) that has been previously set. Furthermore, when the counted value that is the number of times of selecting the meniscus oscillation signal has reached the set value, a signal indicative of this state is output to the selection unit 329. Upon receiving this signal, the selection unit 329 selects the flushing signal when the carriage 2 subsequently reaches the outside of the image forming region, and it forcedly discharges droplets to the ink receiver 8.

Figure 13:
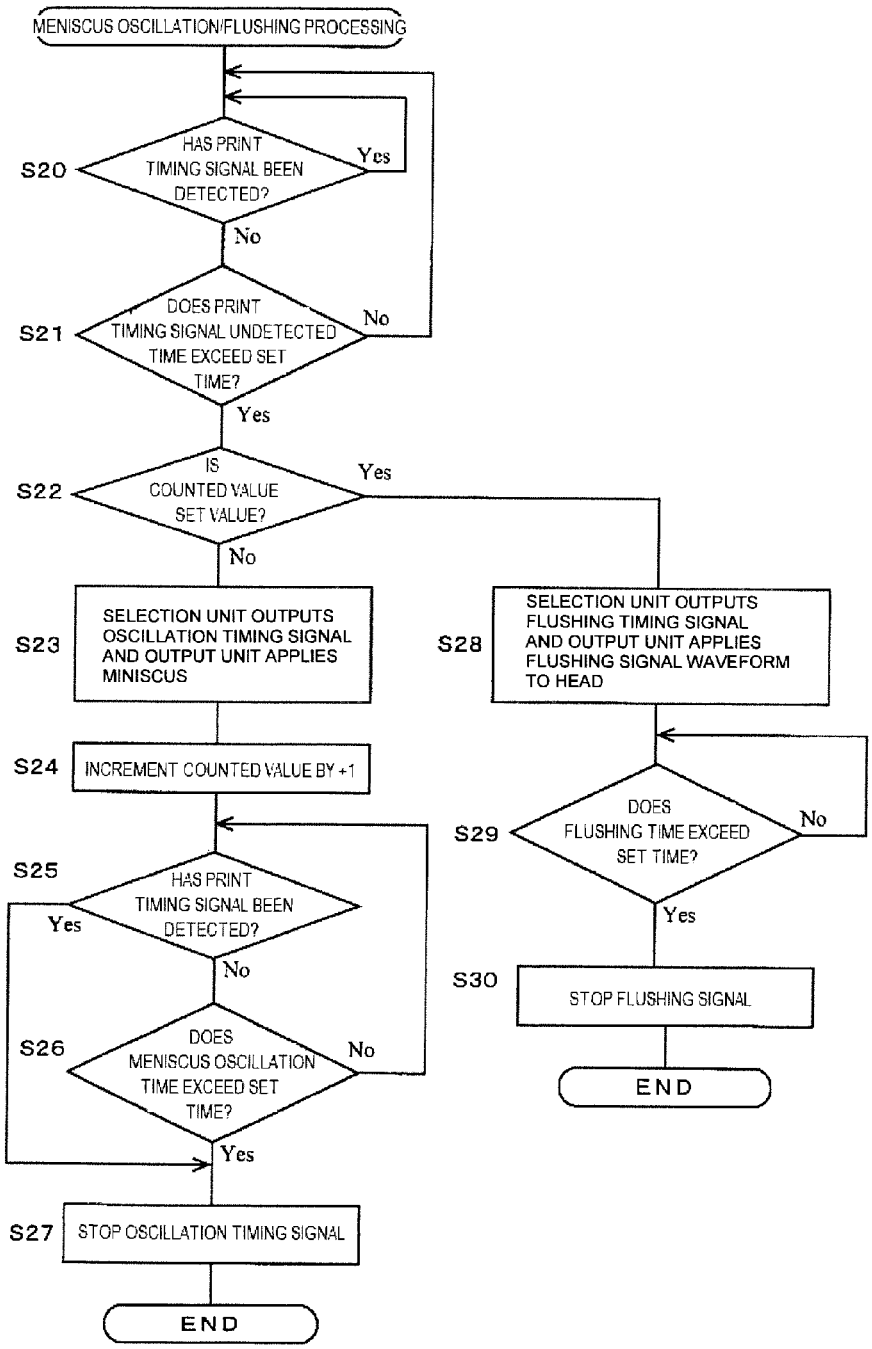
FIG. 13 is a flowchart for explaining processing of selecting meniscus oscillation processing and flushing processing.

A specific flow of meniscus oscillation and flushing processing executed by this inkjet printer will now be described with reference to a flowchart shown in FIG. 13.

Here, a description will be given as to a flow when the selection unit 329 preferentially selects the meniscus oscillation signal request signal and the counting unit 329*a* counts the selected number of times.

The print control apparatus 4 outputs a discharge print request signal used for performing normal image formation to each head drive apparatus 3 and starts a print operation. Then, the carriage 2 having the heads 1 mounted thereon moves on the recording medium P along the main scanning direction. When the carriage 2 comes near to the image forming region, a print trigger signal is output to the print control apparatus 4 from the mechanical control apparatus 7 based on positional information detected and acquired by the encoder sensor 6. Upon inputting this print trigger signal, the print control apparatus 4 continuously outputs the print timing signal to each head drive apparatus 3. As a result, the head drive apparatus 3 discharges droplets from the nozzles of each head 1 based on the print timing signal and the image data from the print control apparatus 4 and forms an image corresponding to one line on the recording medium P along the main scanning direction.

When the carriage 2 has moved to the outside of the image forming region, since data of an image that should be formed in this one line is no longer present, the print timing signal from the print control apparatus 4 is interrupted. In the drive signal selection unit 32 in each head drive apparatus 3, the interrupted time measurement unit 324 keeps measuring an interrupted time of the print timing signal that is continuously output from the print control apparatus 4 (S20, S21). Furthermore, upon detecting that the interrupted time of this print timing signal exceeds a set time that has been previously set (in case of Yes at S21), the drive signal selection unit 32 determines whether the number of times of selecting the meniscus oscillation signal request signal counted by the counting unit 329*a* has reached a set value that has been set in advance (S22).

When it is determined that the counted value provided by the counting unit 329*a* has not reached the set value (in case of No at S22), the selection unit 329 outputs the meniscus oscillation signal request signal from the meniscus oscillation signal request unit 323 to the control unit 311 of the drive signal output unit 31 and also outputs a cyclic oscillation timing signal to the control unit 311 from the cyclic generation unit 326.

When the control unit 311 receives the meniscus oscillation signal request signal, the drive signal output unit 31 controls the waveform switch unit 313, and switches a drive signal, which is output from the drive signal generation unit 312 to each head 1, to the meniscus oscillation signal. Then, the drive signal output unit 31 continuously outputs the meniscus oscillation signal to all the nozzles of each head 1 in synchronization with the oscillation timing signal and oscillates meniscuses of all the nozzles (S23).

The counting unit 329*a* increments the counted value by 1 every time the meniscus oscillation signal request signal is selected by the selection unit 329 (S24).

Then, a state that the print timing signal is not input from the print control apparatus 4 continues (in case of No at S4). The drive signal selection unit 32 keeps measuring a duration time of output of the oscillation timing signal in the time measurement unit 327 (S26). Furthermore, when the time comparison unit 328 detects that the duration time of this oscillation timing signal has exceeded a set time that has been previously set (in case of Yes at S26), the drive signal selection unit 32 outputs a discharge signal request signal to the control unit 311 of the drive signal output unit 31 from the discharge signal request unit 322 and outputs a stop request signal to the meniscus oscillation signal cycle generation unit 326. As a result, the output of the oscillation timing signal is stopped (S27).

On the other hand, if it is determined that the counted value provided by the counting unit 329*a* has reached the set value (in case of Yes at S22), the selection unit 329 switches the flushing signal request signal from the flushing signal request unit 323' to be output to the control unit 311 of the drive signal output unit 31 and outputs the cyclic flushing timing signal to the control unit 311 from the cycle generation unit 326. At this time, the counted value of the counting unit 329*a* is cleared.

When the control unit 311 receives the flushing signal request signal, the drive signal output unit 31 controls the waveform switch unit 313, and switches a drive signal, which is output from the drive signal generation unit 312 to each head 1, to the flushing signal. Then, the drive signal output unit 31 continuously outputs the flushing signal to all the nozzles of each head 1 in synchronization with the flushing timing signal and forcedly discharges droplets from all the nozzles (S28).

A state that the print timing signal is not input from the print control apparatus 4 continues while this flushing timing signal is cyclically output (in case of No at S29). The drive signal selection unit 32 keeps measuring a duration time of output of the flushing timing signal in the time measurement unit 327. Furthermore, upon detecting that the duration time exceeds a set time that has been previously set (in case of Yes at S29), the drive signal selection unit 32 outputs a discharge signal request signal to the control unit 311 of the drive signal output unit 31 from the discharge signal request unit 322 and outputs a stop request signal to the cycle generation unit 326. As a result, the output of the flushing signal is stopped (S30).

As a result, even if the carriage 2 is present outside the image forming region, selecting either the meniscus oscillation signal or the flushing signal enables preventing an increase in viscosity of the inks in the nozzles.

Since the selection unit 329 preferentially selects the meniscus oscillation, consumption of the inks involved by the flushing can be suppressed. Moreover, when the number of times of selecting the meniscus oscillation signal has reached a predetermined number of times, the selection unit 329 automatically switches the signal to the flushing signal, and hence an increase in viscosity of the inks can be suppressed by forced discharge of droplets even though suppressing an increase in viscosity of the inks by the meniscus oscillation alone is difficult, thereby effectively recovering the nozzles.

In the head drive apparatus 3 shown in FIG. 12, the meniscus oscillation signal/flushing termination unit has the time measurement unit 327, the time comparison unit 328, and the time set unit 328*a* like FIG. 4. However, in the head drive apparatus 3, a number-of-time measurement unit 327', a number-of-time comparison unit 328', and a number-of-time set unit 328' that are the same as those in FIG. 8 may be provided in place of the time measurement unit 327, the time comparison unit 328, and the time set unit 328*a* so that the number of times of outputting the oscillation timing signal or the flushing timing signal can be measured.

It is to be noted that, in each foregoing embodiment, like the prior art, when the carriage 2 is present in the image forming region, the meniscus in each nozzle may be oscillated by interposing the meniscus oscillation signal before or after the print timing signal.

EXPLANATION OF LETTERS OR NUMERALS

100, 100': inkjet printer
1: inkjet head
2: carriage
3: head drive apparatus
  31: drive signal output unit
    311: control unit
    312: drive signal generation unit
    313: waveform switch unit
  32: drive signal selection unit
    321*a*: discharge signal waveform data memory
    321*b*: meniscus oscillation signal waveform data memory
    321*c*: flushing signal waveform data memory
    322: discharge signal request unit
    323: meniscus oscillation signal request unit
    323': flushing signal request unit
    324: interrupted time measurement unit
    325: time comparison unit
    325*a*: time set unit
    326: cycle generation unit
    327: time measurement unit
    327': number-of-time measurement unit
    328: time comparison unit
    328': number-of-time comparison unit
    328*a*: time set unit
    328*a'*: number-of-time set unit
    329: selection unit
    329*a*: counting unit
4: print control apparatus
  4*a*: signal line
5: linear encoder
6: encoder sensor
7: mechanical control apparatus
  7*a*: signal line
8: ink receiver
200: printer control apparatus (external apparatus)
  200*a*: signal line

The invention claimed is:

1. A head drive unit comprising:

an inkjet head driven based on a drive signal; and a head drive apparatus that outputs a discharge signal to the inkjet head based on image data and a print timing signal that are input from an external apparatus, and discharges a droplet from a nozzle to form an image on a recording medium, wherein the head drive apparatus comprises:

a drive signal output unit for outputting either the discharge signal used for discharging a droplet from the nozzle to form an image or a flushing signal used for forcedly discharging a droplet from the nozzle without forming an image as a drive signal to the inkjet head, the drive signal output unit continuously applying the flushing signal to all nozzles of the inkjet head in synchronization with a cyclic flushing timing signal when the input interruption detection unit detects that input of the print timing signal has been interrupted;

a cycle generation unit for generating the cyclic flushing timing signal for the flushing signal;

an input interruption detection unit for detecting that no input is made and input of the print timing signal is interrupted even though a preset time has elapsed by monitoring input of the print timing signal; and a drive signal selection unit for selecting the flushing signal as the drive signal output from the drive signal output unit.

2. The head drive unit according to claim 1, wherein the drive signal selection unit has a time measurement unit for measuring a duration time of output of the flushing signal, and wherein the drive signal output unit stops the flushing signal and switches the drive signal to the discharge signal when the flushing signal is selected as the drive signal and then the time measurement unit measures elapse of a preset time.

3. The head drive unit according to claim 1, wherein the drive signal selection unit has a number-of-time measurement unit for measuring the number of times of outputting the flushing signal, and wherein the drive signal output unit stops the flushing signal and switches the drive signal to the discharge signal when the flushing signal is selected as the drive signal and then the number-of-time measurement unit measures a present number of times of outputting the selected signal.

4. An inkjet printer comprising:

a head drive unit according to claim 1;

a recording medium carrying apparatus for carrying the recording medium in a sub-scanning direction;

a head moving apparatus for moving the inkjet head in a main scanning direction crossing a carrying direction of the recording medium;

a positional information detecting apparatus for detecting positional information of the inkjet head relative to the recording medium; and a print control apparatus that continuously outputs the image data and the print timing signal to the head drive apparatus based on the positional information detected by the positional information detecting apparatus only when the inkjet head is present in an image forming region for the recording medium.

5. A head drive unit comprising:

an inkjet head driven based on a drive signal; and a head drive apparatus that outputs a discharge signal to the inkjet head based on image data and a print timing signal that are input from an external apparatus, and discharges a droplet from a nozzle to form an image on a recording medium, wherein the head drive apparatus comprises:

a drive signal output unit for outputting either the discharge signal used for discharging a droplet from the nozzle to form an image or a meniscus oscillation signal for an oscillating liquid surface at a tip of the nozzle without discharging a droplet from the nozzle or a flushing signal used for forcedly discharging a droplet from the nozzle without forming an image to the inkjet head;

a cycle generation unit for generating at least either a cyclic oscillation timing signal for the meniscus oscillation signal or a cyclic flushing timing signal for the flushing signal;

an input interruption detection unit for detecting that no input is made and input of the print timing signal is interrupted even though a preset time has elapsed by monitoring input of the print timing signal; and a drive signal selection unit for selecting the meniscus oscillation signal or the flushing signal as the drive signal output from the drive signal output unit when the input interruption detection unit detects that input of the print timing signal has been interrupted; and wherein the drive signal output unit continuously applies the meniscus oscillation signal to all nozzles of the inkjet head in synchronization with the cyclic oscillation timing signal when the drive signal selection unit selects the meniscus oscillation signal, and continuously applies the flushing signal to all nozzles of the inkjet head in synchronization with the cyclic flushing timing signal when the drive signal selection unit selects the flushing signal.

6. An inkjet printer comprising:

a head drive unit according to claim 5;

a recording medium carrying apparatus for carrying the recording medium in a sub-scanning direction;

a head moving apparatus for moving the inkjet head in a main scanning direction crossing a carrying direction of the recording medium;

a positional information detecting apparatus for detecting positional information of the inkjet head relative to the recording medium; and a print control apparatus that continuously outputs the image data and the print timing signal to the head drive apparatus based on the positional information detected by the positional information detecting apparatus only when the inkjet head is present in an image forming region for the recording medium.

7. The head drive unit according to claim 6, wherein the drive signal selection unit has a timing measurement unit for measuring a duration time of output of the meniscus oscillation signal, and wherein the drive signal output unit stops the meniscus oscillation signal and switches the drive signal to the discharge signal when the meniscus oscillation signal is selected as the drive signal and then the time measurement unit measures elapse of a preset time.

8. The head drive unit according to claim 5, wherein the drive signal selection unit has a number-of-time measurement unit for measuring the number of times of outputting the meniscus oscillation signal, and wherein the drive signal output unit stops the meniscus oscillation signal and switches the drive signal to the discharge signal when the meniscus oscillation signal is selected as the drive signal and then the number-of-time measurement unit measures a preset number of times of outputting the selected signal.

9. The head drive unit according to claim 5, wherein the drive signal selection unit has a time measurement unit for measuring a duration time of output of the flushing signal, and wherein the drive signal output unit stops the flushing signal and switches the drive signal to the discharge signal when the flushing signal is selected as the drive signal and then the time measurement unit measures elapse of a preset time.

10. The head drive unit according to claim 5, wherein the drive signal selection unit has a number-of-time measurement unit for measuring the number of times of outputting the flushing signal, and wherein the drive signal output unit stops the flushing signal and switches the drive signal to the discharge signal when the flushing signal is selected as the drive signal and then the number-of-time measurement unit measures a present number of times of outputting the selected signal.

* * * * *